US005099246A

United States Patent [19]

Skagerlund

[11] Patent Number: 5,099,246

[45] Date of Patent: Mar. 24, 1992

[54] APPARATUS FOR DETERMINING ROLL POSITION

[75] Inventor: Lars-Erik Skagerlund, Karlskoga, Sweden

[73] Assignee: Aktiebolaget Bofors, Karlskoga, Sweden

[21] Appl. No.: 348,528

[22] Filed: May 8, 1989

[30] Foreign Application Priority Data

May 17, 1988 [SE] Sweden ..... 8801831

[51] Int. Cl.[5] ..... H01Q 21/06; F41G 7/00

[52] U.S. Cl. ..... 342/361; 244/3.14; 342/366

[58] Field of Search ..... 342/361-366, 342/355; 344/3.14, 3.19, 3.21

[56] References Cited

U.S. PATENT DOCUMENTS 4,641,801 2/1987 Lynch, Jr. et al. ..... 244/3.14

4,750,689 6/1988 Yff ..... 244/3.14

FOREIGN PATENT DOCUMENTS 0239156 3/1987 European Pat. Off. .

*Primary Examiner*—Gregory C. Issing

*Attorney, Agent, or Firm*—Pollock, Vande Sande & Priddy

[57] ABSTRACT

An apparatus for determining the roll position of a spinning projectile with the aid of polarized electromagnetic radiation comprises a transmitter for emitting polarized radiation in a direction towards the projectile and a polarization-sensitive receiver disposed in the projectile for receiving the polarized radiation. The polarized radiation emitted from the transmitter has an asymmetric wave-form which is formed by superimposing at least two mutually phase-interlocked radiation components of the wavelength relationship of 2:1 and/or multiples thereof, and the polarization-sensitive receiver includes a single receiver antenna.

7 Claims, 4 Drawing Sheets

APPARATUS FOR DETERMINING ROLL POSITION

BACKGROUND OF THE INVENTION

The present invention relates to an apparatus for determining the roll position of a spinning projectile, missile or the like, with the aid of polarized electromagnetic radiation.

The present invention is applicable to all types of projectiles, missiles or the like which spin in their trajectory and in which the roll position needs to be determined. In particular, the present invention can be used in guided ammunition, that is projectiles which are fired in a conventional manner into a ballistic trajectory towards the target and in which such ammunition receives commands for correction. Because the projectile spins in its trajectory, its roll position must be determined when the command is given. Otherwise, in the absence of roll position-determining devices, errors readily occur when correcting the trajectory.

It is previously known in this art to determine the roll angle in relation to a reference direction in, primarily, missiles with the aid of so-called rate gyros, with subsequent integration.

However, the use of gyros is fraught with a number of technical problems such as drift in the gyro, bearing friction, sensitivity to acceleration and the like. In particular, the sensitivity to acceleration renders the gyro unsuitable for use in a projectile which is discharged from, for example, a gun.

It is also previously known in this art to determine the roll position with the aid of emitted planar polarized radiation, for example in SE 409 902 and SE 407 714. In such instances, use is made of a laser emitter, suitably placed in conjunction with the firing point and aimed at the target. The radiation emitted from the laser emitter is planar polarized either directly through the radiation source of the laser emitter, or the light from the radiation source is caused to pass through a subsequent polarization filter. The plane of polarization of the emitted laser beam will, either through the filter or directly through the radiation source, be established in relation to a reference plane in space. At its trailing end, the projectile is equipped with a receiver which, in planar polarized laser radiation, is provided with polarization filters and is operative to receive the emitted laser radiation from the laser emitter.

Because of the rotation or spin of the projectile, the emitter laser radiation will, after the polarization filter in the receiver, give rise to a varying signal from which the roll position may be determined, albeit with a magnitude of uncertainty of 180°, that is half a revolution.

The above-mentioned SE 409 902 discloses one example of how this uncertainty may be eliminated. In this case, it is the missile that emits radiation which is substantially planar polarized, while the receiver is disposed in conjunction with the firing point. In the missile, there is provided a further radiation source which, on a signal from the firing point or at a certain time after discharge of the missile, is separated substantially radially out from the missile. Using measurement equipment, the position of the radiation source in relation to the missile can be determined in the form of an angle and a marking can be realized on the detected signal which, with good accuracy, indicates the roll position of the missile at the moment of separation.

Even though this prior-art apparatus makes determination of the roll position with a relatively high degree of accuracy and without ambiguity, practical problems are involved in providing the missile with a separable radiation source. These problems are further aggravated for projectiles which are discharged conventionally from a gun barrel. Furthermore, the measurement collation apparatus must be such that the position of the radiation source in relation to the missile proper can be determined. Yet a further drawback inherent in such an apparatus is that signal loss will give rise to uncertainty in the roll position determination.

SUMMARY OF THE PRESENT INVENTION

The object of the present invention is to solve the above-outlined problems and to transmit angular information to a projectile, missile or the like, in a simple and unambiguous manner.

BRIEF DESCRIPTION OF THE ACCOMPANYING DRAWINGS

The nature of the present invention and its aspects will be more readily understood from the following brief description of the accompanying Drawings, and discussion of one embodiment of the present invention relating thereto.

In the accompanying Drawings:

FIG. 1 schematically shows a projectile in its trajectory on its way from a firing point towards a target;

FIGS. 2*a* and 2*b* show the curve configuration of the emitted microwave signals;

FIG. 2*c* shows the composite microwave signal;

FIGS. 3*a* and 3*b* show the received signal in relation to the direction of orientation of the receiver antenna;

FIGS. 4*a* and 4*b* show a method of detecting the polarity of the signal;

DESCRIPTION OF PREFERRED EMBODIMENT

Figure 1:
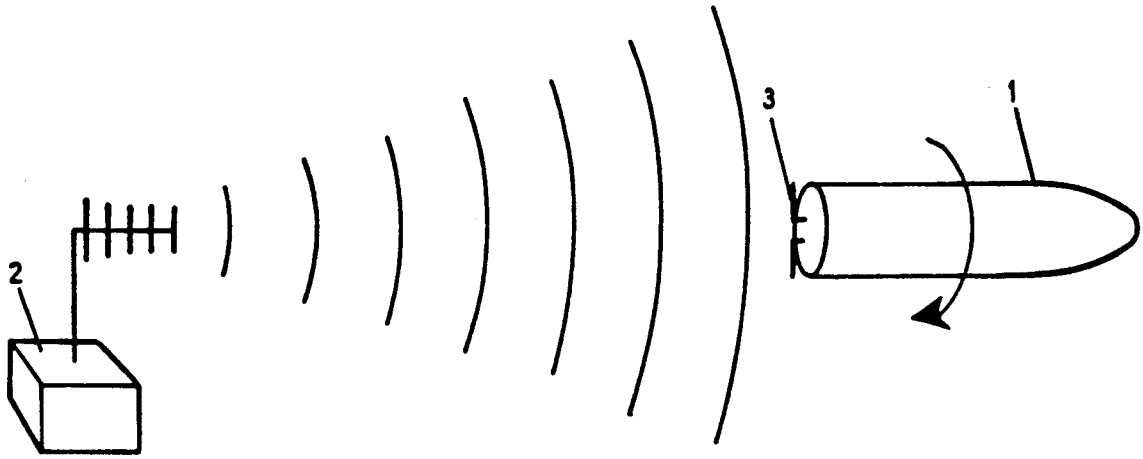

Referring to the drawings, FIG. 1 shows a projectile 1 which, in a conventional manner, has been fired from an artillery barrelled piece or other launching equipment towards a target. To increase the kill probability of the projectile, its course is corrected by means of control pulses. In its trajectory, the projectile is either stabilized by fins and then rotates at a relatively low speed of spin, or is roll stabilized, in which event its speed of spin is high. In order that the course correction be provided, the roll position of the projectile must be determined when the control impulse is impressed upon the trajectory correction devices of the projectile. To this end, a transmitter 2 is provided in an immediate conjunction to the firing point, which transmits polarized electromagnetic radiation, see FIG. 2*a*. The projectile is equipped with a rearwardly-directed receiver antenna 3 for receiving emitted radiation. Preferably, use is made of microwave radiation, since the dimension of the antenna will be smaller and the emitted radiation lobes may be made narrower. The transmitter antenna can either have a fixed polarization plane or a mechanically or electrically rotatable plane. Both microwave transmitters and receivers are previously known in this art and will not, therefore, be described in greater detail here.

Appropriately, the emitted radiation is substantially planarpolarized. The polarization plane is established, through the radiation source, in relation to a reference plane for the control system of the projectile. The manner in which the projectile is guided and corrected in other matters is outside the scope of the present invention and will not, therefore, be described in greater detail here. The receiver is fitted with a polarization-sensitive antenna of a known type and, because the projectile spins, the radiation in the receiver and after detection will give rise to a sinusoidal variable signal of the type shown in FIG. 3*a*. Signals show, after detection, a number of maxima and minima which occur when the roll position of the projectile is such that the polarization plane of the emitted radiation corresponds to that of the receiver. Solely from this signal, the roll position of the projectile may be determined with a relatively high degree of accuracy, but with an ambiguity of 180°, that is half a revolution.

Figure 2A:
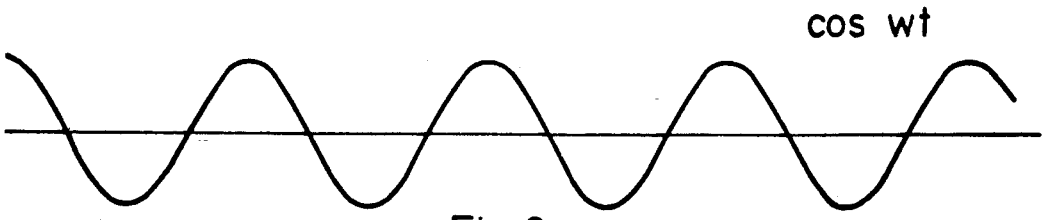
Figure 2B:
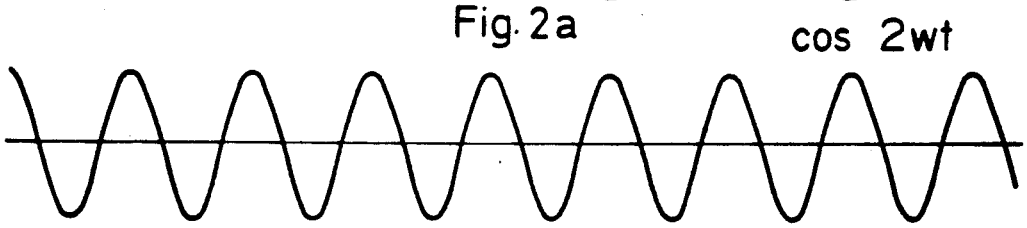

In order to eliminate ambiguity, the polarized microwave radiation now includes, according to the present invention, two components which are mutually fixed with the wavelength relationship of 2:1, see FIG. 2*a* and 2*b* and/or multiples thereof, such as 4:1, 6:1 and so on.

Figure 2C:
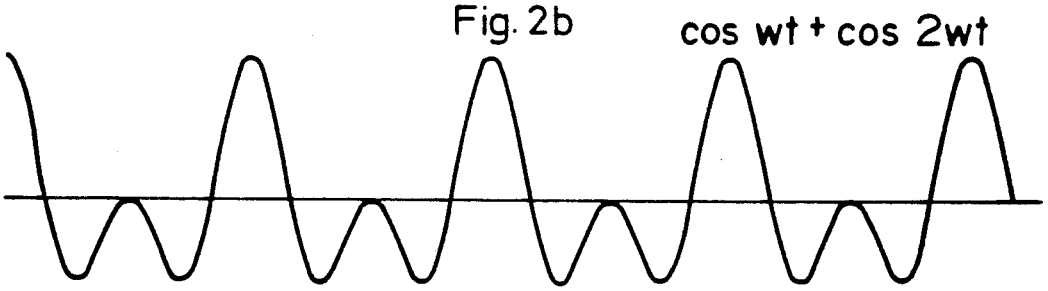

When the two emitted microwave components are superimposed, an asymmetric wave form will be obtained in accordance with FIG. 2*c*.

Figure 3A:
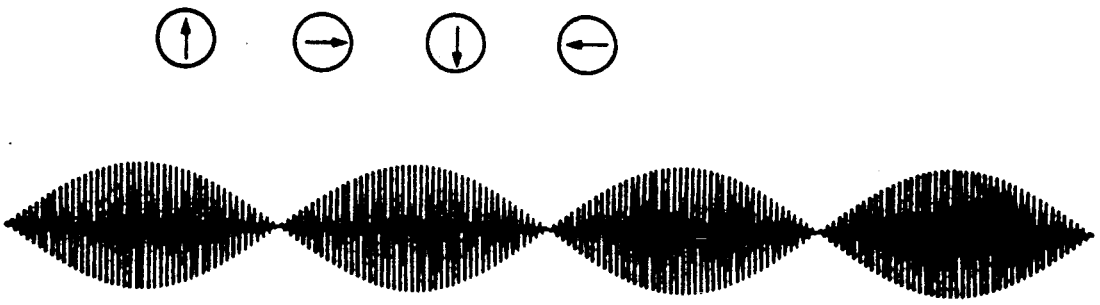
Figure 3B:
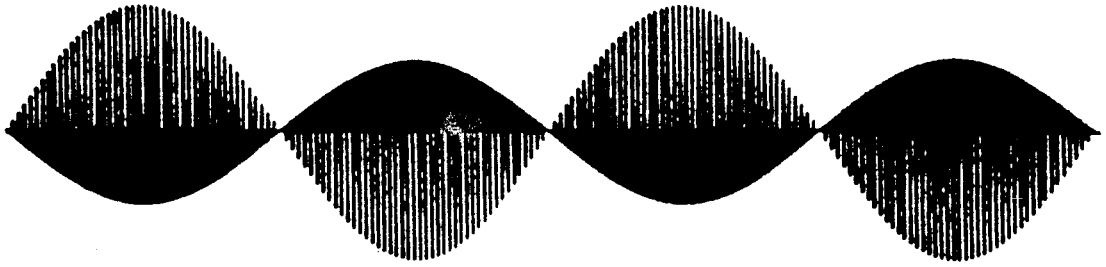

FIGS. 3*a* and *b* show the received signal in relation to the orientation of the projectile, FIG. 3*a* illustrates the situation when only one polarized signal cos wt is emitted in which event an ambiguity of 180° exists. FIG. 3*b* illustrates according to the present invention, in which two polarized signals of the wavelength relationship 2:1 are emitted, i.e. cos wt + cos 2 wt, in which event the asymmetrical curve configuration makes it possible that the above-mentioned ambiguity can be eliminated and the roll position of the projectile be unambiguously determined.

Figure 4A:
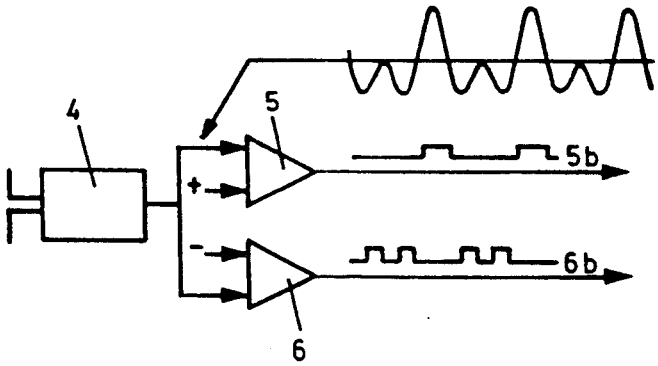
Figure 4B:
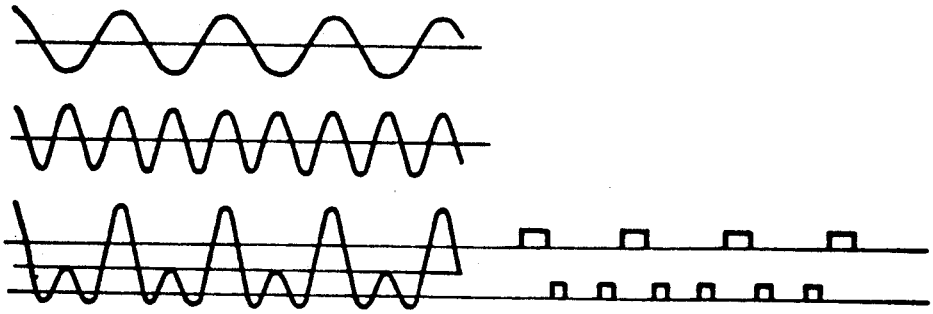

FIG. 4*a* shows a method of detecting the polarity of the signal. The cos wt + cos 2 wt signal emitted from the receiver 4 of the projectile is applied to two parallel threshold circuits 5 and 6 embodying a positive threshold level and negative threshold level 6*a*, respectively. The emitted pulse signals 5*b* and 6*b*, respectively, are then presupposed to be detectable by some known method. FIG. 4*b* shows, by means of a signal diagram, how the two pulse signals are formed. In the one polarization direction, twice the number of pulses are obtained. For example, detection may be effected by a known frequency counter.

Figure 5:
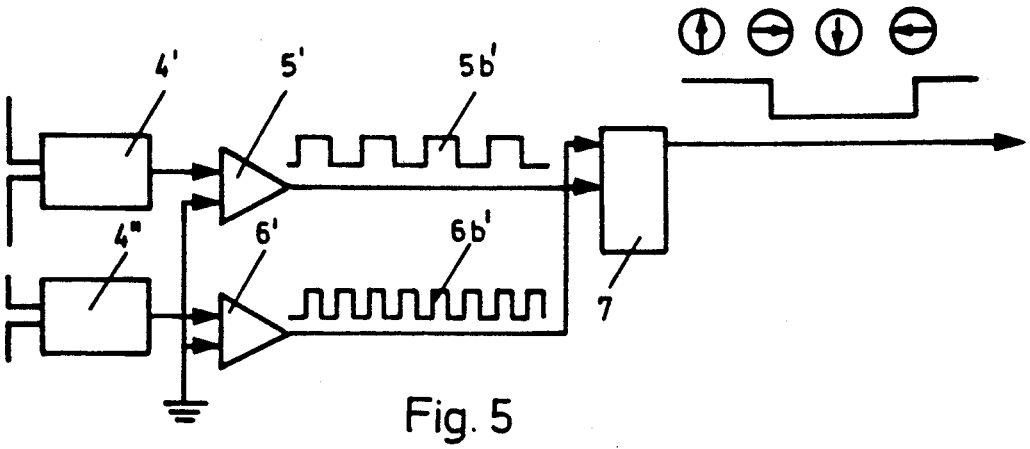
FIG. 5 shows an alternative method therefore.

FIG. 5 illustrates an alternative method for detecting the polarity of the signal. In this case, the projectile is provided with two receivers 4' and 4'', one for each of the two emitted microwave signals. The detected signals cos wt and cos 2 wt are each impressed on their threshold circuit 5' and 6' set at the 0 threshold level. On the output of the threshold circuits, two pulse trains 5*b'* and 6*b'* will then occur according to the Figure, these being supplied to the clock input CK and the D input of a D flip-flop 7 of a known type. On the Q output of the D flip-flop, there will then occur a signal which changes polarity after half a revolution.

Figure 6:
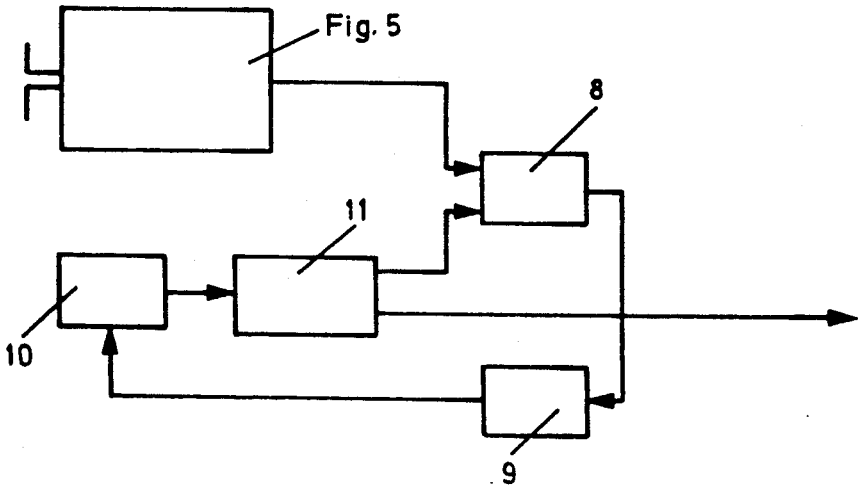
FIG. 6 shows a circuit by means of which the angular position of the projectile can be determined.

FIG. 6 shows a circuit by means of which the angular position (roll position) of the projectile may then be determined. The receiver of the projectile, with signal processing means, for example according to FIG. 5, then emits a pulse signal to a circuit comprising a phase comparator 8 in which the pulse signal is compared with the output signal from a counter 11 and which emits a voltage signal proportional to the phase difference between the two input signals. The output signal controls, through a low-pass filter 9 which gives zero fault frequency in a voltage-controlled oscillator 10 whose output is connected to the counter 11. The counter 11 then emits a binary signal (most significant binary figure) to the phase comparator 8 and a binary output signal (all binary figures).

As was mentioned above, the microwave radiation enjoys advantages because the smaller dimension of the antenna. One disadvantage inherent in the microwave radiation is, however, the high frequency, and there may be a need to transpose the frequency to a more easily operable level.

Figure 7:
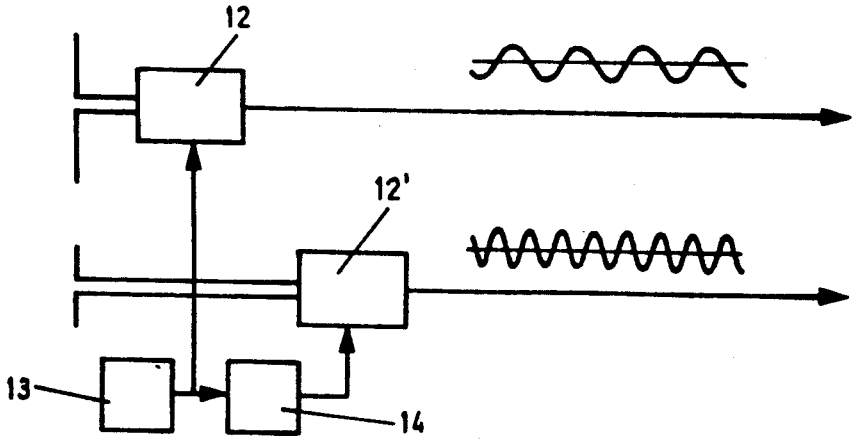
FIGS. 7 and 8 show two methods for frequency transposition.

FIG. 7 shows a method for frequency transposition. Both of the emitted microwave signals are each applied, on reception, to their mixer 12, 12'. An oscillator 13 is directly connected to the mixer 12 and, by the intermediary of a frequency multiplier 14 to the mixer 12'.

Figure 8:
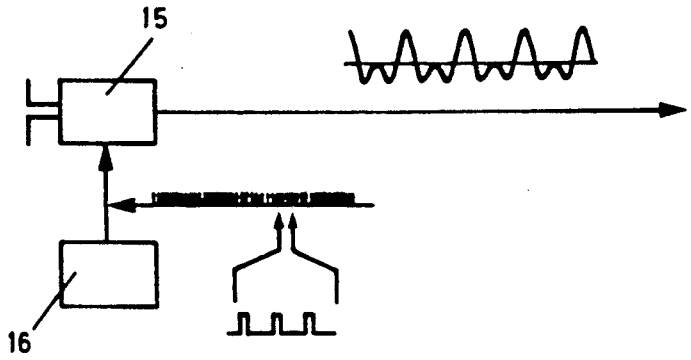
Figure 9:
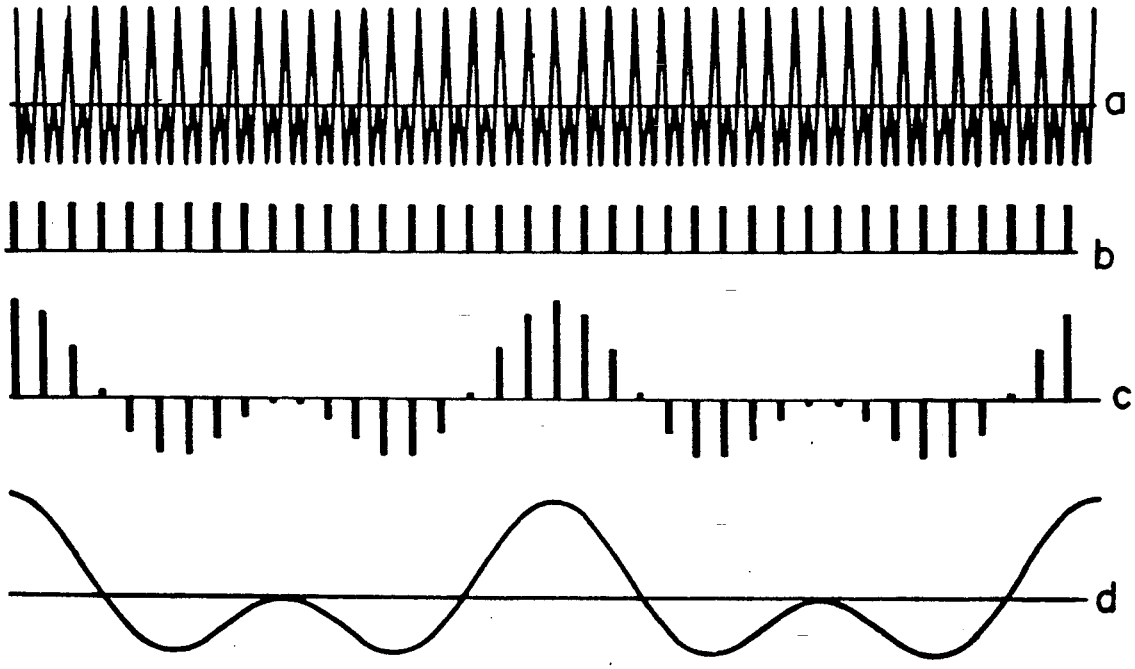
FIG. 9 is a signal diagram for the frequency transposition according to FIG. 8.

FIG. 8 shows an alternative method for frequency transposition in which the composite cos wt + cos 2 wt signal which is received in the projectile is mixed, in a mixer 15, with the signal from a harmonic frequency rich oscillator 16. FIG. 9 shows a signal diagram for the frequency transposition according to FIG. 8, with the input signal a to the mixer 15, the oscillator signal b and the output signal c from the mixer. After filtering, there will be obtained a symmetric curve form d of low medium frequency from which the roll position of the projectile may unambiguously be determined.

The present invention should not be considered as restricted to the embodiment disclosed above by way of example, but may be varied without departing from the spirit and scope of the appended Claims. For example, the radiation source of the emitted electromagnetic radiation may be placed in the projectile and the receiver in conjunction with the firing point.

What we claim and desire to secure by Letters Patent is:

1. An apparatus for determining the roll position of a spinning projectile with the aid of polarized electromagnetic radiation, comprising a transmitter for emitting polarized radiation in a direction towards the projectile and a polarization-sensitive receiver diposed in the projectile for receiving the polarized radiation, said polarized radiation emitted from the transmitter having an asymmetric wave-form which is formed by superimposing at least two mutually phase-interlocked radiation components of the wavelength relationship of 2:1 and/or multiples thereof, and wherein said polarization-sensitive receiver includes a single receiver antenna.

2. The apparatus as claimed in claim 1, wherein the emitted radiation lies within the microwave region.

3. The apparatus as claimed in claim 1, wherein the received, composite signal is supplied to two threshold circuits with positive and negative threshold levels, respectively, whereby two signals of different pulse frequencies are emitted from which the polarity of the received signal may be determined.

4. The apparatus as claimed in claim 1, wherein the received radiation components of the composite signal are each supplied to one of two threshold circuits of substantially zero threshold level, and wherein two pulse signals being emitted at the outputs of the threshold circuits are coupled to a D flip-flop adapted to emit an output signal of varying polarity.

5. The apparatus as claimed in claim 4, wherein said output signal is supplied to a phase comparator in which said output signal is compared with the signal from a counter, the output of the phase comparator being connected through a low pass filter to a voltage-controlled oscillator which is connected to said counter.

6. The apparatus as claimed in claim 2, wherein the received microwave signal is operative to be mixed with two phase-locked frequencies of the relationship 2:1 and/or multiples thereof from a harmonic frequency-rich local oscillator for obtaining a signal of lower frequency.

7. The apparatus as claimed in claim 2, wherein the received composite microwave signal is supplied to a mixer in which the signal is mixed with the signal from a harmonic frequency-rich oscillator, to obtain an asymmetric waveform signal of low intermediate frequency from which, after filtering, the roll position of the projectile may unambiguously be determined.

* * * * *